US006969158B2

(12) United States Patent
Taira

(10) Patent No.: US 6,969,158 B2
(45) Date of Patent: Nov. 29, 2005

(54) INK-JET HEAD

(75) Inventor: Hiroshi Taira, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/668,194

(22) Filed: Sep. 24, 2003

(65) Prior Publication Data

US 2004/0119790 A1 Jun. 24, 2004

(30) Foreign Application Priority Data

Sep. 26, 2002 (JP) ..... 2002-280581

(51) Int. Cl.[7] ..... B41J 2/045
(52) U.S. Cl. ..... 347/70; 347/40
(58) Field of Search ..... 347/20, 54, 56, 347/68, 70–72, 40, 63, 65, 67

(56) References Cited

U.S. PATENT DOCUMENTS 5,512,793 A 4/1996 Takeuchi et al. ..... 347/68
5,748,214 A * 5/1998 Usui et al. ..... 347/70

FOREIGN PATENT DOCUMENTS

| | | | |
|---|---|---|---|
| EP | 0 666 605 A1 | 8/1995 | |
| EP | 1 138 493 A1 | 10/2001 | ..... B41J 2/14 |
| EP | 1 316 426 A1 | 6/2003 | ..... B41J 2/14 |
| JP | A 7-214779 | 8/1995 | ..... B41J 2/045 |
| JP | A 2000-334943 | 12/2000 | ..... B41J 2/045 |
| JP | A 2002-86715 | 3/2002 | |

* cited by examiner

*Primary Examiner*—Juanita D. Stephens
(74) *Attorney, Agent, or Firm*—Oliff & Berridge, PLC

(57) ABSTRACT

An ink-jet head comprises a passage unit with pressure chambers formed therein, and actuator units for changing the volume of each pressure chamber. In the passage unit, a plurality of cavity recesses each communicating with both a nozzle for ejecting ink and a common ink chamber and each constituting a cavity of the pressure chamber are arranged in a matrix. Further in the passage unit, formed are a plurality of peripheral recesses arranged along a whole periphery of the cavity recesses. The actuator unit closes openings of the cavity recesses to define a plurality of pressure chambers with the passage unit, and changes the volume of each pressure chamber.

15 Claims, 10 Drawing Sheets

INK-JET HEAD

BACKGROUND OF THE INVENTION

1. Field of the Invention

The invention relates to an ink-jet head, and particularly to an ink-jet head in which a plurality of pressure chambers are arranged in a matrix to neighbor each other.

2. Description of Related Art

There is known a type of ink-jet head in which ink is ejected through a nozzle communicating with each pressure chamber when pressure is applied by a piezoelectric element to the ink in each of the pressure chambers arranged in one or two rows in an in-line shape. The ink-jet head is manufactured by laminating a plurality of plates. Generally, the pressure chambers are formed by a single plate having holes being sandwiched from both faces thereof by other plates, respectively.

Accordingly, in case of bonding a plurality of plates constituting the pressure chambers to each other with an adhesive, the adhesive applied to interfaces of the plates flows into the holes during a manufacturing process of the ink-jet head, and as a result, a shape of the pressure chamber is changed. Such a phenomenon occurs particularly for pressure chambers disposed on both ends of a row, among a plurality of pressure chambers arranged in one or two rows, because there is not formed any hole for a pressure chamber on one side of each of the pressure chambers disposed on both ends of a row. Further, among the plurality of pressure chambers thus arranged, the pressure chambers disposed on both ends of a row are different from the other pressure chambers in bending amount of sidewalls thereof due to a difference in thickness of the sidewalls. Like this, a difference in a shape of pressure chambers due to a flowed-in adhesive and a difference in a bending amount of side walls of pressure chambers are caused between the pressure chambers disposed on both ends of a row and the other pressure chambers, among a plurality of pressure chambers arranged in one or two rows, thereby causing a difference in ink ejecting characteristics. To solve this problem, there is known a technique to provide pressure chambers performing no ink ejection, i.e., dummy pressure chambers, on both ends in an arrangement direction of the plurality of pressure chambers arranged in one or two rows.

Recently, there have been various attempts to realize a printing at high speed and with high picture quality, in one of which pressure chambers are arranged in a matrix, instead of in an in-line shape. Also in this case, similarly to the above-described ink-jet head in which the pressure chambers are arranged in the in-line shape, there may be caused a problem that ink ejecting characteristics of the pressure chambers vary depending on three-dimensional structures surrounding the respective pressure chambers, which differ from each other due to positions in a group of pressure chambers in which a plurality of pressure chambers are arranged in a matrix.

Thus, an objective of the invention is to provide an ink-jet head capable of reducing variance in ink ejecting characteristics depending on positions in a group of pressure chambers formed with a plurality of pressure chambers arranged in a matrix to neighbor each other.

SUMMARY OF THE INVENTION

According to one aspect, an ink-jet head of the present invention comprises: a passage unit including a plurality of cavity recesses arranged in a matrix, each communicating with both a nozzle for ejecting ink and a common ink chamber and each constituting a cavity of a pressure chamber, and a plurality of peripheral recesses arranged along a whole periphery of the plurality of cavity recesses and each communicating with neither the nozzle nor the common ink chamber; and an actuator unit that closes openings of the cavity recesses to define a plurality of pressure chambers with the passage unit, and change the volume of each pressure chamber.

According to another aspect, an ink-jet head of the present invention comprises: a first plate including a plurality of cavity holes arranged in a matrix, each constituting a cavity of a pressure chamber, and a plurality of peripheral holes arranged along a whole periphery of the plurality of cavity holes; a second plate put on one face of the first plate such that an opening on one side of each cavity hole is closed; and a third plate formed with first and second connection holes corresponding to each of the plurality of cavity holes, the third plate being put on the other face of the first plate such that the first and second connection holes are connected with the corresponding cavity hole to define the plurality of pressure chambers with the first plate and the second plate.

In this case, the second plate may be a plate such as a piezoelectric sheet included in the actuator unit, or may be a plate included in the passage unit and made of the same material as that of the first plate.

According to the present invention, in case that a group of pressure chambers, (group of cavity recesses or group of cavity holes) is formed by a plurality of pressure chambers being arranged in a matrix, the pressure chambers disposed at an outermost periphery of the group of pressure chambers and the pressure chambers disposed at portions other than the outermost periphery of the group of pressure chambers are prevented from being largely different from each other in their shapes due to a flowed-in adhesive, and further, there is not caused so much difference from each other in a bending amount of sidewalls of pressure chambers during ink ejection. Accordingly, it becomes possible to obtain almost the same ink ejecting characteristics both in the pressure chambers disposed at the outermost periphery of the group of pressure chambers and in the pressure chambers disposed at portions other than the outermost periphery of the group of pressure chambers.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
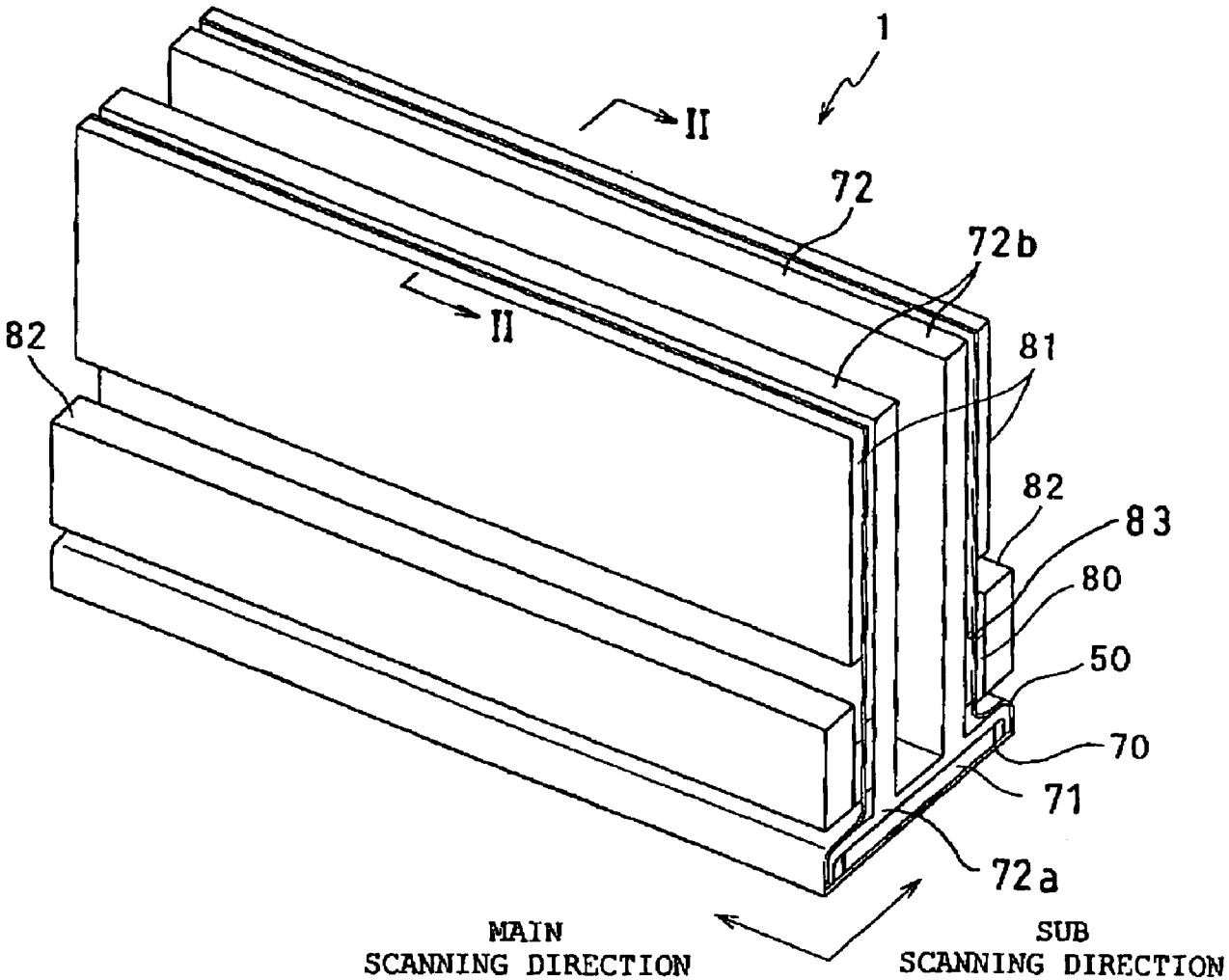
FIG. 1 is an external perspective view of an ink-jet head according to a first embodiment of the invention.
Figure 2:
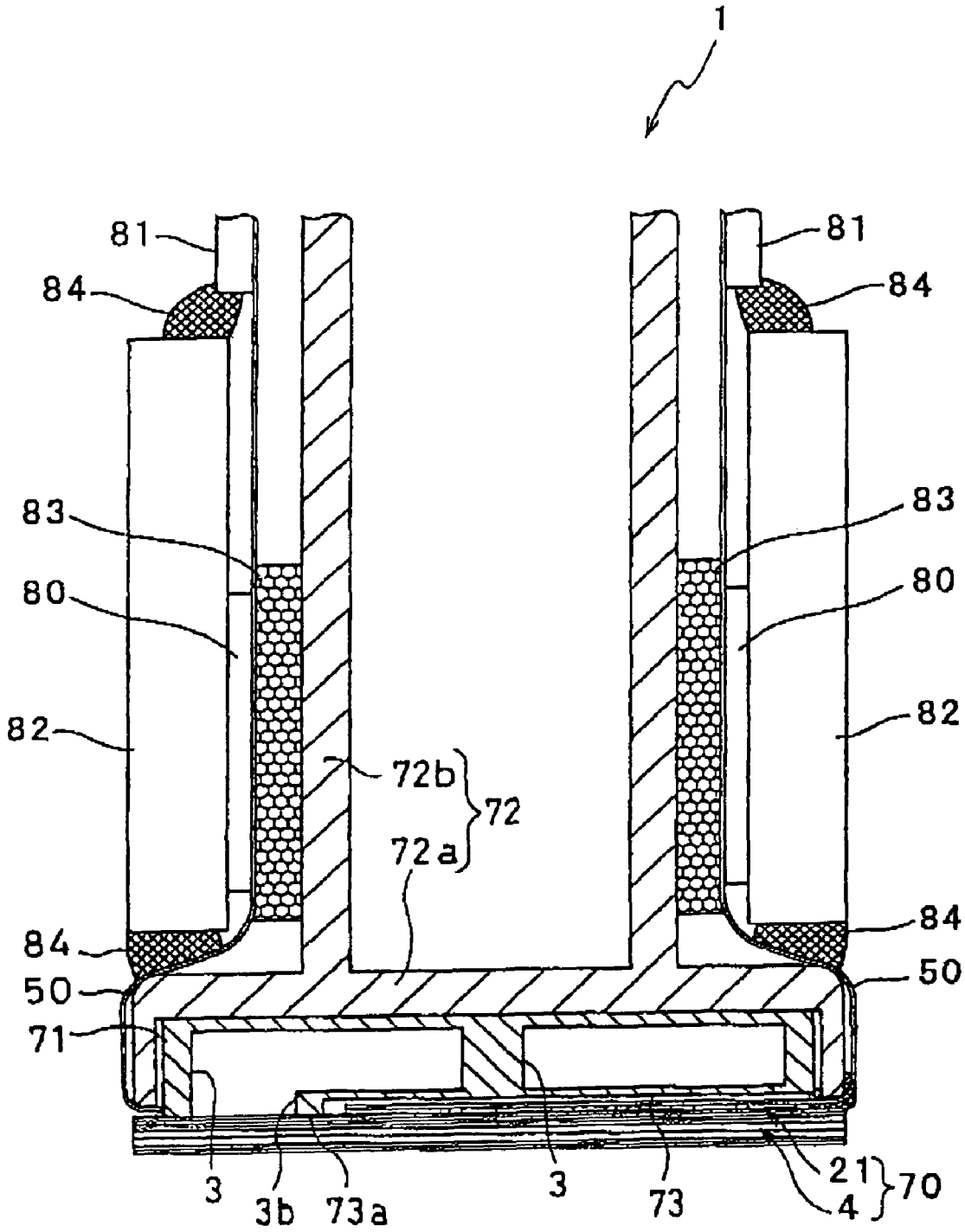
FIG. 2 is a sectional view of the ink-jet head illustrated in FIG. 1.

An ink-jet head according to a first embodiment of the invention will hereinafter be described. FIG. 1 is a perspective view of an ink-jet head 1 according to this embodiment. FIG. 2 is a sectional view taken along line II—II of FIG. 1. The ink-jet head 1 includes a head main body 70 ejecting ink onto a paper and having a rectangular shape in a plan view extending in the main scanning direction, and a base block 71 disposed above the head main body 70 and formed therein with two ink reservoirs 3 that serve as passages for ink supplied to the head main body 70.

The head main body 70 includes a passage unit 4 formed with ink passages, and a plurality of actuator units 21 bonded to an upper face of the passage unit 4. Both the passage unit 4 and the actuator units 21 are formed of a plurality of thin plates being laminated and bonded to each other. A flexible printed circuit (FPC) 50 as a power supply member is bonded on an upper face of the actuator unit 21, and the FPC is drawn out to right or left.

Figure 3:
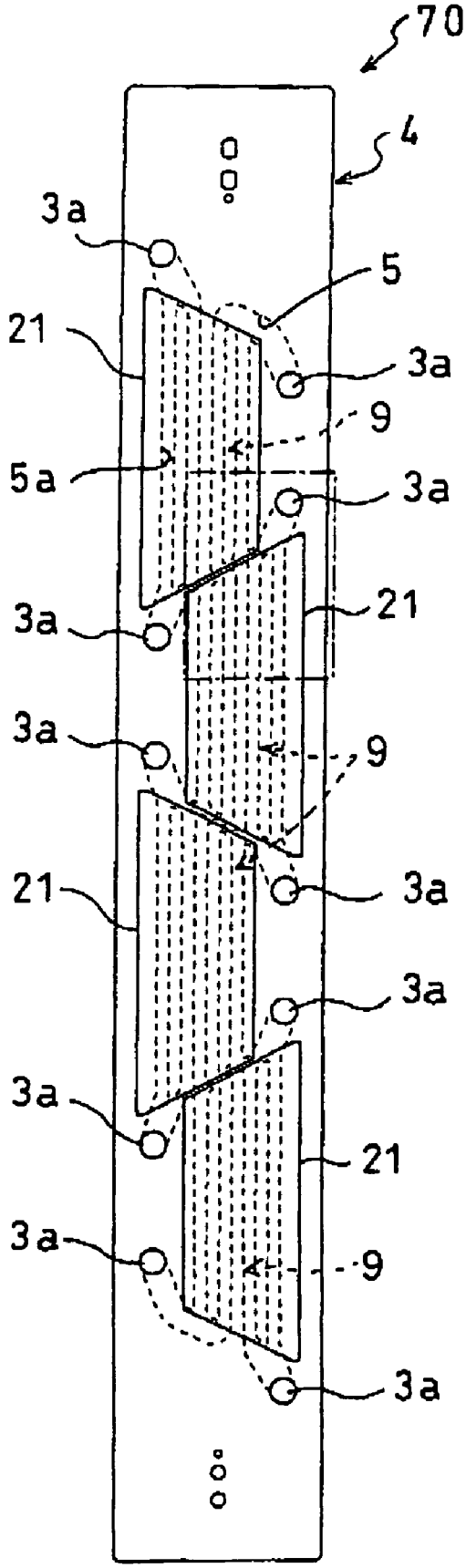
FIG. 3 is a plan view of a head main body included in the ink-jet head illustrated in FIG. 1.

FIG. 3 is a plan view of the head main body 70. Referring to FIG. 3, the passage unit 4 has a rectangular shape in the plan view extending in a direction (the main scanning direction). In FIG. 3, manifold channels 5 as common ink chambers provided in the passage unit 4 are illustrated with a broken line. The manifold channels 5 are supplied with ink from the ink reservoirs 3 of the base block 71 through a plurality of openings 3*a*. Each manifold channel 5 branches into a plurality of sub-manifold channels 5*a* extending in parallel with a longitudinal direction of the passage unit 4.

Four actuator units 21 having a trapezoidal shape in a plan view arranged in two lines in a zigzag shape so as to keep away from the openings 3*a* are bonded onto the upper face of the passage unit 4. Each actuator unit 21 is disposed such that its parallel opposed sides (upper and lower sides) may extend along the longitudinal direction of the passage unit 4. Oblique sides of each neighboring actuator units 21 partially overlap each other in the lateral direction of the passage unit 4.

A lower face of the passage unit 4 corresponding to a bonded region of each actuator unit 21 serves as an ink ejection region where a large number of nozzles 8 (see FIG. 5) are arranged in a matrix. A group of pressure chambers 9 in which a large number of pressure chambers 10 (see FIG. 5) are arranged in a matrix is formed on a surface of the passage unit 4 facing to each actuator unit 21.

Referring again to FIG. 2, the base block 71 is made of a metallic material such as stainless steel. The ink reservoir 3 in the base block 71 is a nearly rectangular parallelepiped hollow region formed along a longitudinal direction of the base block 71. The ink reservoir 3 communicates with an ink tank (not illustrated) through an opening (not illustrated) provided at one end thereof, so that the ink reservoir 3 is always filled up with ink. In the ink reservoir 3, pairs of openings 3*b* are provided in a zigzag pattern along a longitudinal direction of the ink reservoir 3 in regions where no actuator unit 21 is present so as to be connected with the openings 3*a*.

In a lower face 73 of the base block 71, a vicinity of each opening 3*b* protrudes downward from a surrounding portion. The base block 71 contacts with the passage unit 4 only at a vicinity portion 73*a* of each opening 3*b* of the lower face 73. Thus, a region of the lower face 73 of the base block 71, other than the vicinity portion 73*a* of each opening 3*b*, is distant from the head main body 70. Actuator units 21 are disposed within this distance.

The base block 71 is bonded and fixed into a recess formed at a lower face of a holding portion 72*a* of a holder 72. The holder 72 includes the holding portion 72*a* and a pair of protrusions 72*b* of flat plate shape each extending at a predetermined interval therebetween from an upper face of the holding portion 72*a* in a direction perpendicular to the upper face of the holding portion 72*a*. The FPC 50 bonded to the actuator unit 21 is arranged so as to extend along surfaces of the protrusions 72*b* of the holder 72 with an elastic member 83 such as a sponge being interposed between them. A driver IC 80 is mounted on the FPC 50 arranged on the surface of the protrusion 72*b* of the holder 72. The FPC 50 is electrically connected with both the driver IC 80 and the actuator unit 21 of the head main body 70 by soldering in order to transmit driving signals output from the driver IC 80 to the actuator unit 21.

Since a heat sink 82 of nearly rectangular parallelepiped shape is disposed in close contact with an outer side face of the driver IC 80, heat generated in the driver IC 80 can be efficiently dissipated. A substrate 81 is disposed outside the FPC 50 above the driver IC 80 and the heat sink 82. An upper face of the heat sink 82 is bonded to the substrate 81 with a seal 84. Also, a lower face of the heat sink 82 is bonded to the FPC 50 with a seal 84.

Figure 4:
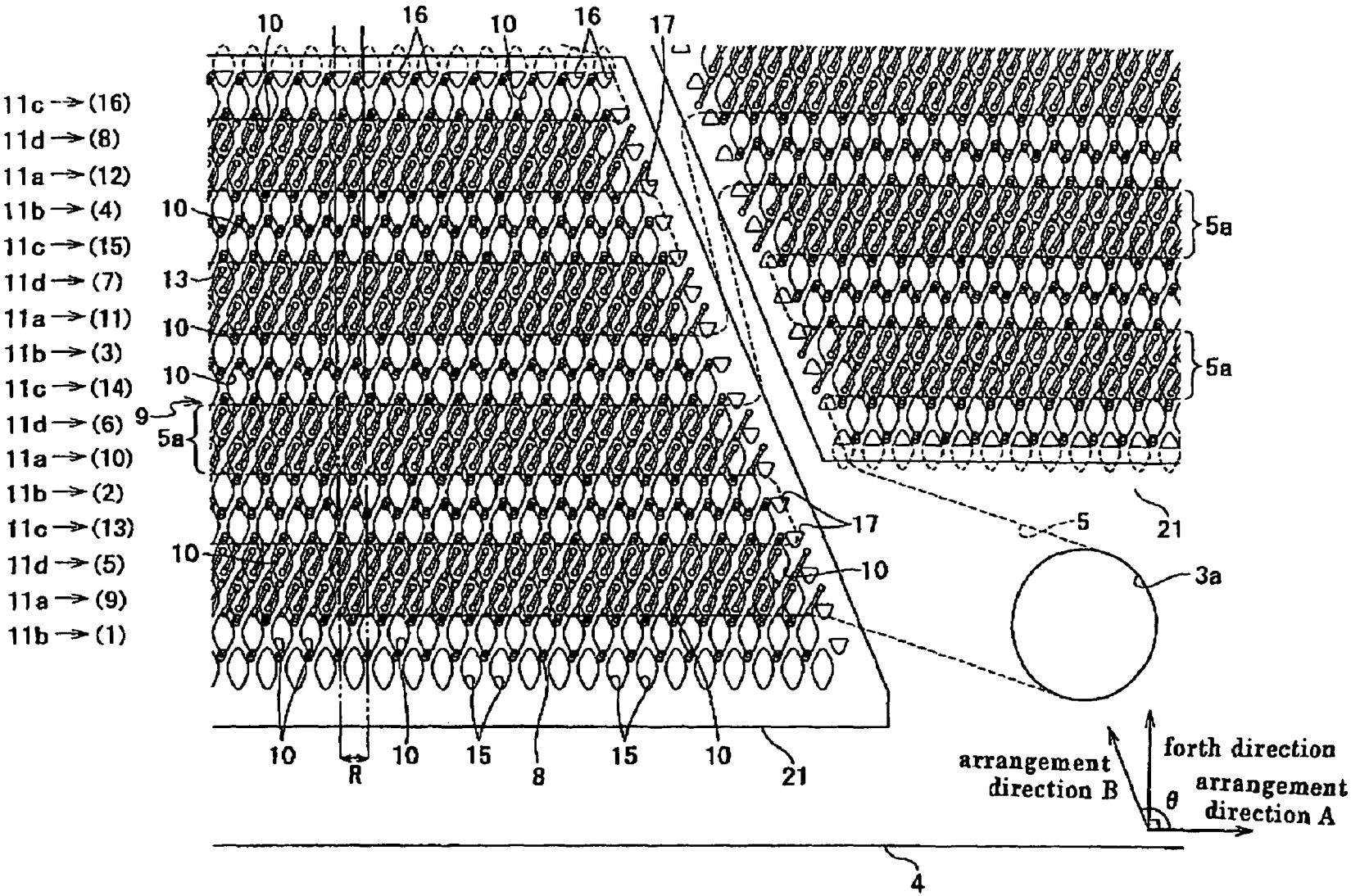
FIG. 4 is an enlarged view of the region enclosed by an alternate long and short dash line illustrated in FIG. 3.
Figure 5:
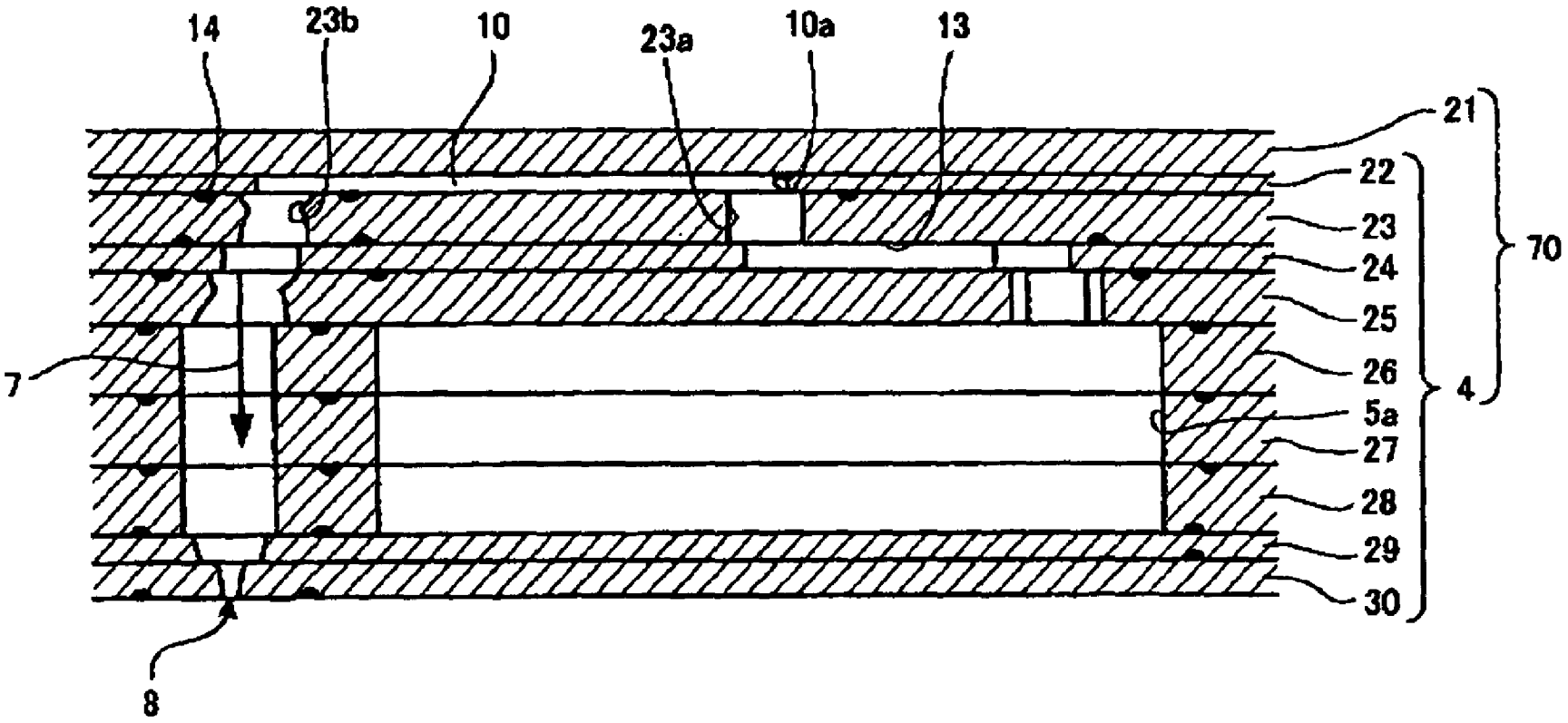
FIG. 5 is a partial sectional view corresponding to a pressure chamber in the head main body illustrated in FIG. 3.

FIG. 4 is an enlarged view of the region enclosed by an alternate long and short dash line illustrated in FIG. 3. Referring to FIG. 4, in areas within the passage unit 4 corresponding to the actuator unit 21, four sub-manifold channels 5*a* extend in parallel with the longitudinal direction of the passage unit 4. Many individual ink passages, extending from an outlet of each sub-manifold 5*a* to the nozzle 8, are connected with each sub-manifold channel 5*a*. FIG. 5 is a sectional view showing the individual ink passage. As shown in FIG. 5, each nozzle 8 communicates with a sub-manifold channel 5*a* through a pressure chamber 10 and an aperture, i.e., a restriction, 13. Thus, within the head main body 70 formed are individual ink passages 7 each corresponding to a respective pressure chamber 10 and each extending from an outlet of a sub-manifold channel 5*a* to a nozzle 8 through an aperture 13 and a pressure chamber 10.

Referring to FIG. 5, the head main body 70 has a layered structure laminated with ten sheet materials in total, i.e., from the top, an actuator unit 21, a cavity plate 22, a base plate 23, an aperture plate 24, a supply plate 25, manifold plates 26, 27, and 28, a cover plate 29, and a nozzle plate 30, among which nine plates other than the actuator unit 21 constitute the passage unit 4.

As described later in detail, the actuator unit 21 is laminated with four piezoelectric sheets 41 to 44 (see FIG. 9) and is provided with electrodes so that only an uppermost layer includes portions to be active only when an electric field is applied (hereinafter, simply referred to as "layer including active layers (active portions)"), and remaining three layers are inactive. The cavity plate 22 is made of metal, in which a large number of substantially rhombic openings (hereinafter referred to as "cavity hole" and indicated by a reference numeral 10*a*) each constituting a cavity of each pressure chamber 10 are formed within a range of the cavity plate 22 attached to the actuator unit 21. The base plate 23 is made of metal, in which a communication hole 23*a* between each pressure chamber 10 of the cavity plate 22 and a corresponding aperture 13, and a communication hole 23*b* between a pressure chamber 10 and a corresponding nozzle 8 are formed.

The aperture plate 24 is made of metal, in which, in addition to holes to be apertures 13, communication holes are formed for connecting each pressure chamber 10 of the cavity plate 22 with a corresponding nozzle 8. The supply plate 25 is made of metal, in which communication holes between each aperture 13 and a corresponding sub-manifold channel 5*a* and communication holes for connecting each pressure chamber 10 of the cavity plate 22 with a corresponding nozzle 8 are formed. Each of the manifold plates 26, 27, and 28 is made of metal, in which, in addition to sub-manifold channel 5*a*, communication holes are formed for connecting each pressure chamber 10 of the cavity plate 22 with a corresponding nozzle 8. The cover plate 29 is made of metal, in which communication holes are formed for connecting each pressure chamber 10 of the cavity plate 22 with a corresponding nozzle 8. The nozzle plate 30 is made of metal, in which nozzles 8 are formed for respective pressure chambers 10 of the cavity plate 22.

These ten sheets 21 to 30 are positioned in layers with each other to form such an individual ink passage 7 as illustrated in FIG. 5. The ink passage 7 first extends upward from the sub-manifold channel 5*a*, then extends horizontally in the aperture 13, then further extends upward, then again extends horizontally in the pressure chamber 10, then extends obliquely downward in a certain length to get apart from the aperture 13, and then extends vertically downward toward the nozzle 8.

A pressure chamber 10 is defined by laminating the actuator unit 21, the cavity plate 22, and the base plate 23 such that an upper openings of cavity holes 10*a* may be closed with the actuator unit 21 and two communication holes 23*a*, 23*b* formed in the base plate 23 may be both connected with a corresponding cavity hole 10*a*. That is, in the state where the passage unit 4 and the actuator unit 21 are not laminated, a large number of recesses (cavity recesses) each constituting a cavity of each pressure chamber 10 are arranged in a matrix on a surface of the passage unit 4.

Referring to FIG. 5, the pressure chambers 10 and the apertures 13 are disposed at different levels from one another in thickness direction of the plates. Therefore, as shown in FIG. 4, in a portion of the passage unit 4 corresponding to an actuator unit 21, an aperture 13 communicating with one pressure chamber 10 can be disposed within the same portion in plan view as a position of a pressure chamber 10 neighboring that pressure chamber 10 communicating with the aperture 13. As a result, because pressure chambers 10 can be arranged close to each other at a high density, high-resolution image printing can be achieved with an ink-jet head 1 having a relatively small occupation area.

On upper faces and lower faces of the base plate 23 and the manifold plate 28, upper faces of the supply plate 25 and manifold plates 26, 27, and a lower face of the cover plate 29, escape grooves 14 for draining extra adhesives are disposed in such a manner as to surround openings formed on bonded faces of each of the plates. The providing of the escape grooves 14 can prevent an adhesive used in bonding each plate from going into an individual ink passage to vary a passage resistance in the individual ink passage.

Referring again to FIG. 4, a group of pressure chambers 9 constituted by a large number of pressure chambers 10 is formed within a range attached to the actuator unit 21. The group of pressure chambers 9 has a trapezoidal shape of substantially the same size as the range attached to the actuator unit 21. The group of pressure chambers 9 is formed corresponding to each one of actuator unit 21.

As shown in FIG. 4, each pressure chamber 10 belonging to the group of pressure chambers 9 is communicated with a nozzle 8 at one end of a longer diagonal thereof, and communicated through an aperture 13 with a sub-manifold channel 5*a* at the other end of the longer diagonal thereof. As described later, on the upper face of each actuator unit 21, individual electrodes 35 having a nearly rhombic shape in a plan view somewhat smaller than the pressure chamber 10 are arranged in a matrix so as to correspond to the respective pressure chambers. In FIG. 4, to facilitate understanding of the drawings, nozzles 8, pressure chambers 10, and apertures 13, etc., are illustrated with solid lines though they should be illustrated with broken lines because they are in the passage unit 4.

Pressure chambers 10 are arranged adjacent to each other in a matrix in two directions, i.e., an arrangement direction A (first direction) and an arrangement direction B (second direction). The arrangement direction A is a longitudinal direction of the ink-jet head 1, i.e., an extending direction of the passage unit 4, and parallel with a shorter diagonal of a pressure chamber 10. The arrangement direction B is along an oblique side of a pressure chamber 10, which makes an obtuse angle theta, θ, with the arrangement direction A. Both acute portions of each pressure chamber are located between other two neighboring pressure chambers.

The pressure chambers 10 arranged adjacent to each other in a matrix in two directions of the arrangement direction A and the arrangement direction B are spaced from each other along the arrangement direction A by a distance corresponding to 37.5 dpi. Sixteen pressure chambers 10 are arranged in the arrangement direction B in one actuator unit 21.

A large number of pressure chambers 10 arranged in a matrix constitute pressure chamber rows along the arrangement direction A in FIG. 4. When viewing perpendicularly to FIG. 4 (third direction), the pressure chamber rows are classified into first, second, third, and forth pressure chamber rows 11*a*, 11*b*, 11*c*, and 11*d*, respectively, in accordance with their relative positions with sub-manifold channels 5*a*. Each of these first to forth pressure chamber rows 11*a* to 11*d* are periodically disposed four times in order of, from an upper side toward a lower side of the actuator unit 21, 11*c*, 11*d*, 11*a*, 11*b*, 11*c*, 11*d*, . . . 11*b* in series.

In pressure chambers 10*a* constituting the first pressure chamber rows 11*a* and pressure chambers 10*b* constituting the second pressure chamber rows 11*b*, nozzles 8 are deviated downward in FIG. 4 with respect to a direction perpendicular to the arrangement direction A (forth direction), when viewing from the third direction. Each nozzle 8 faces to a vicinity of a lower end of a corresponding pressure chamber 10. In pressure chambers 10*c* constituting the third pressure chamber rows 11*c* and pressure chambers 10*d* constituting the forth pressure chamber rows 11*d*, on the other hand, nozzles 8 are deviated upward in FIG. 4 with respect to the forth direction. Each nozzle 8 faces to a vicinity of an upper end of a corresponding pressure chamber 10. In the first and forth pressure chamber rows 11*a*, 11*d*, no less than half area of the pressure chambers 10*a*, 10*b* overlaps with a sub-manifold channel 5*a*, when viewing from the third direction. In the second and third pressure chamber rows 11*b*, 11*c*, an almost whole area of the pressure chambers 11*b*, 10*c* does not overlap with a sub-manifold channel 5*a*, when viewing from the third direction. Therefore, in a pressure chamber 10 belonging to any pressure chamber row, a nozzle 8 communicating with the pressure chamber 10 can avoid overlapping with the sub-manifold 5*a*, while a width of the sub-manifold 5*a* can be made as large as possible to smoothly supply ink to each pressure chamber 10.

Figure 6A:
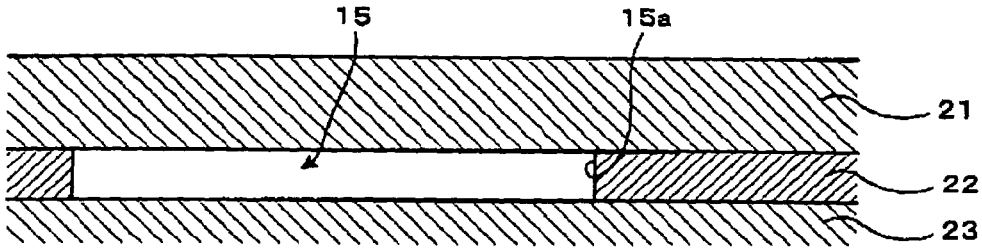
FIG. 6A, FIG. 6B, and FIG. 6C are partial sectional views corresponding to a peripheral cavity in the head main body illustrated in FIG. 3.

As shown in FIG. 4, in a head main body 70, a large number of peripheral cavities 15 having the same shape and the same size as those of a pressure chamber 10 are arranged in a straight line along a long side, among a pair of parallel sides of a trapezoidal group of pressure chambers 9, over a whole area of the long side. The peripheral cavities 15 are, as shown in FIG. 6A showing a peripheral cavity 15 sectioned along the forth direction, defined by laminating an actuator unit 21, a cavity plate 22, and a base plate 23 such that holes (peripheral holes 15*a*) formed in the cavity plate 22 and having the same shape and the same size as those of the pressure chamber 10 may be closed by the actuator unit 21 and the base plate 23. That is, in the state where the passage unit 4 and the actuator unit 21 are not laminated, a large number of recesses (peripheral recesses) each constituting a cavity of each peripheral cavity 15 are arranged on a surface of the passage unit 4 in a straight line along the long side of the group of pressure chambers 9. Since the peripheral cavities are closed with the base plate 23 within the passage unit 4, an ink passage is not connected to the peripheral cavity 15, and no individual electrode 35 is provided opposing to each peripheral cavity 15. Thus, the peripheral cavity 15 does not perform an ink ejection.

The peripheral cavities 15 are formed with the same pitch as that of the pressure chambers 10 with respect to a longitudinal direction of the passage unit 4. A distance between the peripheral cavity 15 and a pressure chamber 10 adjacent thereto is the same as a distance between the neighboring pressure chambers 10 in the group of pressure chambers 9. Further, a part of a contour (two sides leading to one acute portion of a rhombic shape) of a peripheral cavity 15 and a part of a contour (two sides leading to one acute portion of a rhombic shape) of a pressure chamber 10 facing to each other are parallel. An acute portion of a peripheral cavity 15 facing to the group of pressure chambers 9 is located between two pressure chambers 10 adjacent to this peripheral cavity 15. Like this, since the peripheral cavities 15 are arranged adjacent to the pressure chambers 10 disposed at an outermost periphery of the group of pressure chambers 9, the pressure chambers 10 disposed at the outermost periphery of the group of pressure chambers 9 may be surrounded by a three-dimensional structure equal to a three-dimensional structure obtained in a case where they are disposed at an inner area of the group of pressure chambers 9. Thus, an amount of adhesive flowed into a pressure chamber 10 and a bending amount of a sidewall of a pressure chambers 10 are not distributed regardless of locations within the group of pressure chambers 9, so as to obtain almost the same ink ejecting characteristics within the group of pressure chambers 9. That is, the peripheral cavities 15 contribute to an ink ejection in terms of providing uniform ink ejecting characteristics within the group of pressure chambers 9.

Figure 6B:
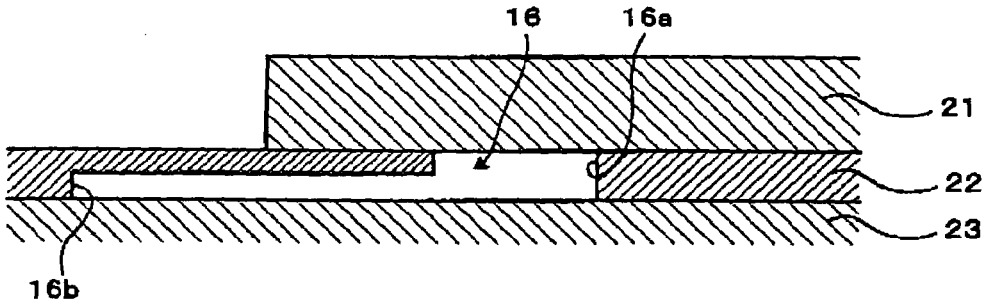

In the head main body 70, moreover, a large number of peripheral cavities 16 are arranged in a straight line along a short side, among a pair of parallel sides of a trapezoidal group of pressure chambers 9, over a whole area of the short side. The peripheral cavities 16 are, as shown in FIG. 6B showing a peripheral cavity 16 sectioned along the forth direction and in FIG. 4, defined by laminating an actuator unit 21, a cavity plate 22, and a base plate 23 such that holes (peripheral holes 16*a*) formed in the cavity plate 22 may be closed by the actuator unit 21 and the base plate 23. The peripheral cavity 16 has such a shape that, in a recess 16*b*, only an equilateral triangle area in a plan view in the recess 16*b* nearer a pressure chamber 10 (equivalent to a part of a rhombic shape of the pressure chamber 10) is penetrating. The recess 16*b* is formed on a lower face side of the cavity plate 22, and has the same shape in a plan view as that of the pressure chamber 10 and a depth of about the half of thickness of the cavity plate 22. That is, in the state where the passage unit 4 and the actuator unit 21 are not laminated, a large number of recesses (peripheral recesses) each constituting a cavity of each peripheral cavities 16 are arranged on a surface of the passage unit 4 in a straight line along the short side of the group of pressure chambers 9. An ink passage is not connected to the peripheral cavity 16, and no individual electrode 35 is provided corresponding to each peripheral cavity 16.

In this way, since a part of the peripheral holes 16*a* forms a recess 16*b* such that an opening is not formed at a portion along the short side of the actuator unit 21, a sufficient adhesive strength of the cavity plate 22 and the actuator unit 21 can be maintained while preventing the shape of the peripheral cavity 16 from being largely different from the shape of the pressure chamber 10.

The peripheral cavities 16 are formed with the same pitch as that of the pressure chambers 10 with respect to a longitudinal direction of the passage unit 4. A distance between the peripheral cavity 16 and a pressure chamber 10 adjacent thereto is the same as a distance between the neighboring pressure chambers 10 in the group of pressure chambers 9. Further, a part of a contour (two sides leading to one acute portion of a rhombic shape) of a peripheral cavity 16 and apart of a contour (two sides leading to one acute portion of a rhombic shape) of a pressure chamber 10 facing to each other are parallel. An acute portion of a peripheral cavity 16 facing to the group of pressure chambers 9 is located between two pressure chambers 10 adjacent to this peripheral cavity 16. Like this, the pressure chambers 10 disposed at the outermost periphery of the group of pressure chambers 9 may be surrounded by a three-dimensional structure similar to a three-dimensional structure of the pressure chambers 10 disposed at the inner area of the group of pressure chambers 9. Accordingly, although the peripheral cavities 16 do not eject ink, they contribute to an ink ejection in terms of providing uniform ink ejecting characteristics of the pressure chambers 10 within the group of pressure chambers 9.

Figure 6C:
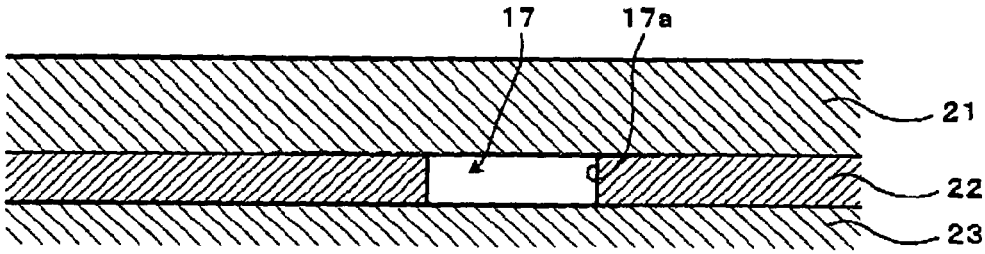

In the head main body 70, further, a large number of peripheral cavities 17 are arranged in a straight line along both oblique sides of a trapezoidal group of pressure chambers 9 over a whole area of the both oblique sides. The peripheral cavities 17 are, as shown in FIG. 6C showing a peripheral cavity 17 sectioned along the forth direction and in FIG. 4, defined by laminating an actuator unit 21, a cavity plate 22, and a base plate 23 such that holes (peripheral holes 17*a*) formed in the cavity plate 22 may be closed by the actuator unit 21 and the base plate 23. The peripheral hole 17*a* has an equilateral triangle shape in a plan view equivalent to a part of a rhombic shape of the pressure chamber 10. That is, in the state where the passage unit 4 and the actuator unit 21 are not laminated, a large number of recesses (peripheral recesses) each constituting a cavity of each peripheral cavities 17 are arranged on a surface of the passage unit 4 in a straight line along the both oblique sides of the group of pressure chambers 9. An ink passage is not connected to the peripheral cavity 17, and no individual electrode 35 is provided corresponding to each peripheral cavity 17.

The peripheral cavities 17 are formed with the same pitch as that of the pressure chambers 10 with respect to the arrangement direction B. A distance between the peripheral cavity 17 and a pressure chamber 10 adjacent thereto is the same as a distance between the neighboring pressure chambers 10 in the group of pressure chambers 9. Further, a part of a contour (one side of an equilateral triangle) of a peripheral cavity 17 and a part of a contour (one side of an equilateral triangle) of a pressure chamber 10 facing to each other are parallel. Thus, the peripheral cavities 17 arranged along the oblique sides of the group of pressure chambers 9 serve to homogenize the three-dimensional structure surrounding the pressure chambers 10, regardless of locations within the group of pressure chambers 9. Accordingly, although the peripheral cavities 17 themselves do not eject ink, they contribute to an ink ejection in terms of providing uniform ink ejecting characteristics of the pressure chambers 10 within the group of pressure chambers 9.

Figure 7:
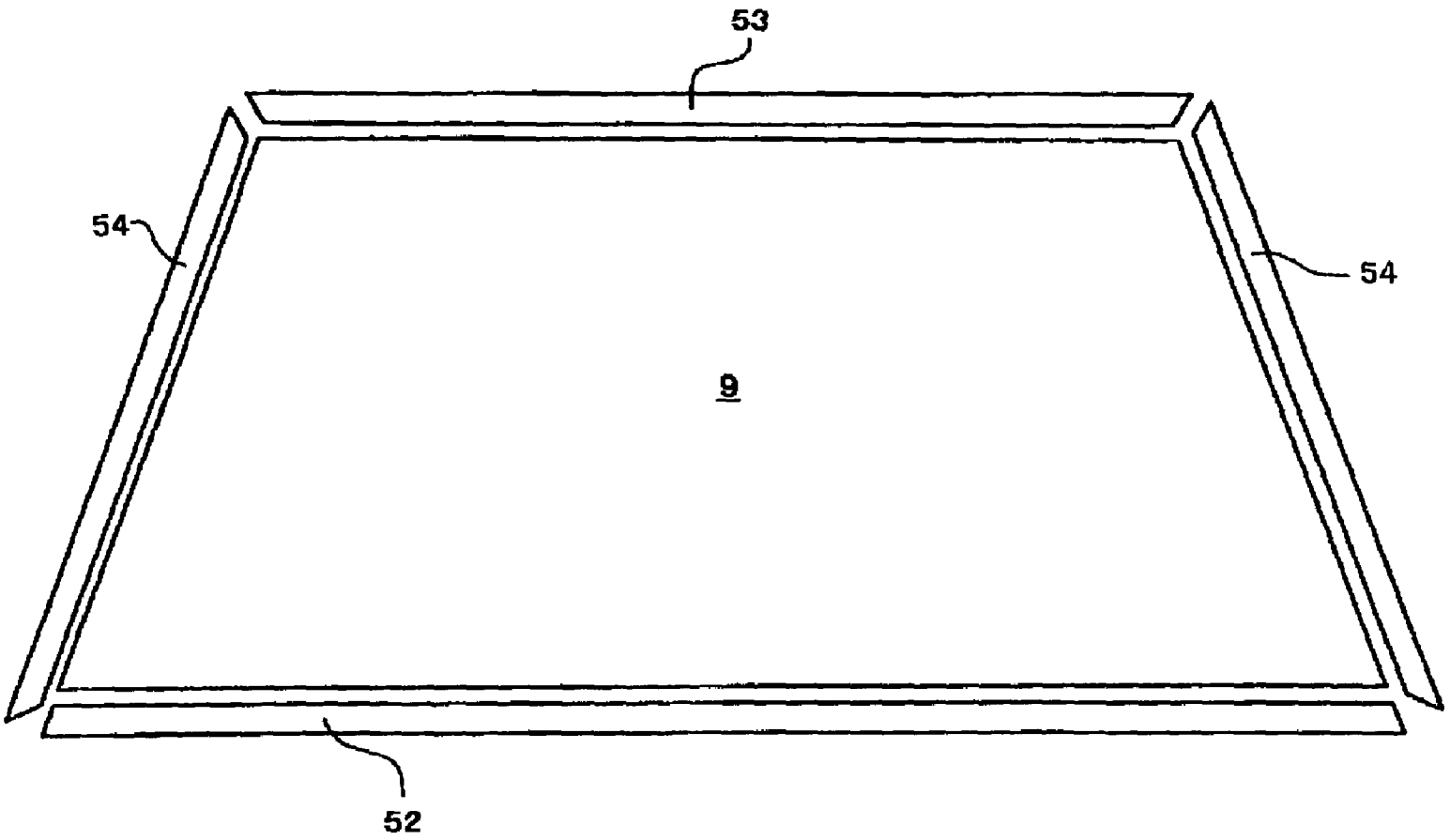
FIG. 7 is a schematic view showing a positional relationship between a group of pressure chambers and groups of peripheral cavities.

As described above, in this embodiment, each group of pressure chambers 9 formed in the head main body 70 is surrounded by a large number of peripheral cavities 15, 16, and 17 formed over a whole periphery of the group of pressure chambers 9 at the same interval as that of neighboring pressure chambers. FIG. 7 schematically shows this condition. Referring to FIG. 7, a group 52 of peripheral cavities 15 is formed along a long side of the group of pressure chambers 9, a group 53 of peripheral cavities 16 is formed along a short side of the group of pressure chambers 9, and a group 54 of peripheral cavities 17 is formed along both oblique sides of the group of pressure chambers 9, respectively.

Accordingly, a passage for a pressure chamber 10 disposed at an outermost periphery of a group of pressure chambers 9 can be prevented from being clogged by a flowed-in adhesive during bonding an actuator unit 21 and a cavity plate 22, and at the same time the pressure chamber 10 disposed at the outermost periphery of the group of pressure chambers 9 and a pressure chamber 10 disposed at a portion other than the outermost periphery of the group of pressure chambers 9 are prevented from being different from each other in their shapes due to a flowed-in adhesive, so that both of these pressure chambers 10 have almost the same shape. Further, the pressure chamber 10 disposed at the outermost periphery of the group of pressure chambers 9 and the pressure chamber 10 disposed at the portion other than the outermost periphery of the group of pressure chambers 9 have the same positional relationship with cavities, which means any pressure chambers 10 or any peripheral cavities, surrounding each of these pressure chambers 10. Therefore, there is not caused a difference in a bending amount of sidewalls of pressure chambers between both of these pressure chambers during ink ejection. Accordingly, in the ink-jet head 1 according to this embodiment, the pressure chamber 10 disposed at the outermost periphery of the group of pressure chambers 9 and the pressure chamber 10 disposed at the portion other than the outermost periphery of the group of pressure chambers 9 demonstrate almost the same ink ejecting characteristics.

Particularly, in the ink-jet head 1 according to this embodiment, the above-mentioned advantages are reinforced by the states where facing portions of the peripheral cavity 15, 16, and 17 and the pressure chambers 10 are parallel to each other, a distance between the peripheral cavities 15, 16, and 17 and a pressure chamber 10 adjacent thereto is the same as a distance between the neighboring pressure chambers 10, and acute portions of the peripheral cavities 15, 16 are located between two pressure chambers 10 adjacent to those peripheral cavities 15, 16. The above-mentioned advantages are further reinforced with respect to the long side of the group of pressure chambers 9, because the peripheral cavity 15 and the pressure chamber 10 have the same shape and the same size. Further, according to this embodiment, a sufficient amount of spacing is secured between a pressure chamber 10 disposed at the outermost periphery of the group of pressure chambers 9 and an outer periphery of the actuator unit, because the peripheral cavities 15, 16, and 17 are formed by openings of peripheral recesses being closed with the actuator unit 21. Thus, an operation of the actuator unit 21 in regions corresponding to the pressure chambers 10 disposed at the outermost periphery of the group of pressure chambers 9 can be stabilized. Further, since the openings of the peripheral recesses are wholly closed with the actuator unit 21, a peripheral portion of the actuator unit 21 is underpinned by the cavity plate 22. Thus, the peripheral portion of the actuator unit 21 is not damaged or cracked due to a pressure applied for bonding the actuator unit 21 onto the cavity plate 22 with an adhesive, thereby improving a manufacture yield of the ink-jet head 1.

Next, a construction of an actuator unit 21 will be described. A large number of individual electrodes 35 having the same pattern as that of the pressure chamber 10 are arranged in a matrix on the actuator unit 21. Each individual electrode 35 is arranged at a position corresponding to the respective pressure chamber 10 in a plan view.

Figure 8:
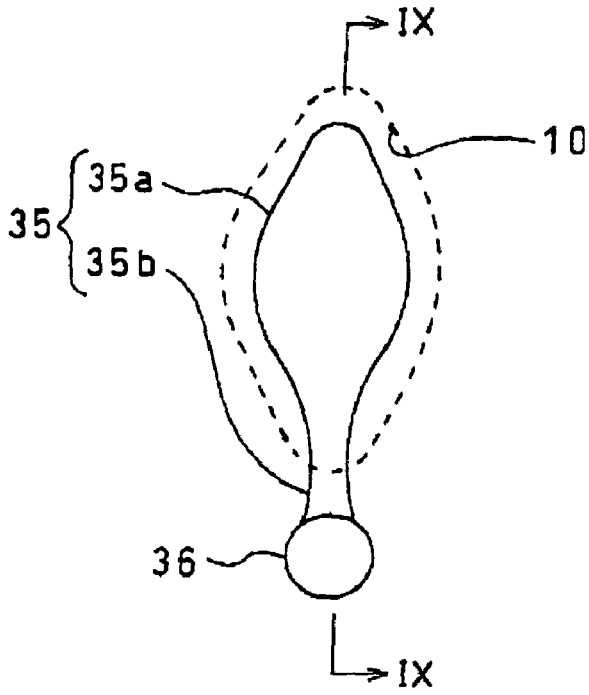
FIG. 8 is a plan view of an individual electrode formed on an actuator unit illustrated in FIG. 3.

FIG. 8 is a plan view of an individual electrode 35. Referring to FIG. 8, the individual electrode is composed of the main electrode region 35*a* arranged at a position corresponding to the pressure chamber 10 and included in the pressure chamber 10 in a plan view, and an auxiliary electrode region 35*b* formed continuously from the main electrode region 35*a* and arranged at a position corresponding to an outside of the pressure chamber 10.

Figure 9:
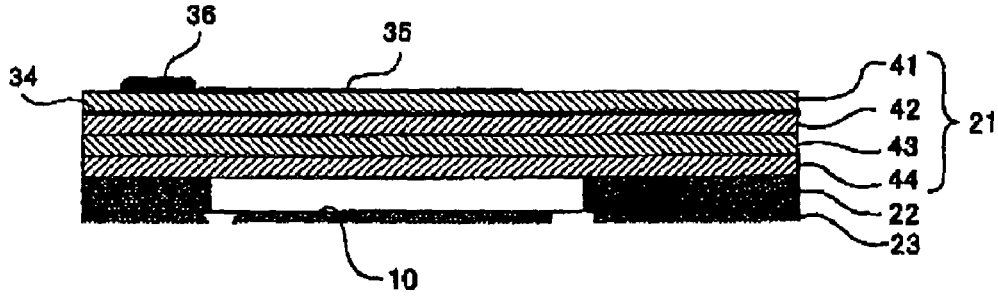
FIG. 9 is a partial sectional view of the actuator unit illustrated in FIG. 3.

FIG. 9 is a sectional view taken along line IX—IX of FIG. 8. Referring to FIG. 9, the actuator unit 21 includes four piezoelectric sheets 41, 42, 43, and 44 having the same thickness of about 15 micrometers. These piezoelectric sheets 41 to 44 are made into a continuous layered flat plate (continuous flat layers) that is so disposed as to extend over many pressure chambers 10 formed within one ink ejection region in the head main body 70. Since the piezoelectric sheets 41 to 44 are disposed so as to extend over many pressure chambers 10 as the continuous flat layers, the individual electrodes 35 can be arranged on the piezoelectric sheet 41 at a high density by using, e.g., a screen printing technique. Therefore, the pressure chambers 10, formed at positions corresponding to the individual electrodes 35, can also be arranged in a high density so that a high-resolution image can be printed. Each of the piezoelectric sheets 41 to 44 is made of a lead zirconate titanate (PZT)-base ceramic material having ferroelectricity.

As shown in FIG. 8, the main electrode region 35*a* of the individual electrode 35 formed on the uppermost piezoelectric sheet 41 has a generally rhombic shape in a plan view similar to that of the pressure chamber 10. A lower acute portion in the generally rhombic main electrode region 35*a* extends out to lead to the auxiliary electrode region 35*b* corresponding to the outside of the pressure chamber 10. A circular land portion 36 electrically connected with the individual electrode 35 is provided at an end of the auxiliary electrode region 35*b*. Referring to FIG. 9, the land portion 36 corresponds to a region in a cavity plate 22 having no pressure chamber 10 formed. The land portion 36 is made of, e.g., gold including glass frits and bonded onto a surface of the extending-out portion in the auxiliary electrode region 35*b*, as shown in FIG. 8. The land portion 36 is electrically bonded to a contact formed in an FPC 50, while an illustration of the FPC 50 is omitted in FIG. 9. When bonding the land portion 36 to the FPC 50, it is necessary to press the contact of the FPC 50 onto the land portion 36. Since the pressure chamber 10 is not formed in the region in the cavity plate 22 corresponding to the land portion 36, sufficient pressing can be performed, thus to obtain a reliable bonding.

A common electrode 34 having the same configuration as that of the piezoelectric sheet 41 and a thickness of about 2 micrometers is interposed between the uppermost piezoelectric sheet 41 and the piezoelectric sheet 42 disposed under the piezoelectric sheet 41. Both the individual electrodes 35 and the common electrode 34 are made of, e.g., an Ag—Pd-base metallic material.

The common electrode 34 is grounded in a not-illustrated region. Thus, the common electrode 34 is equally kept at a fixed potential, e.g., the ground potential in this embodiment, at a region corresponding to any pressure chamber 10. Each individual electrode 35 corresponding to a respective pressure chamber 10 is connected to a driver IC 80 through a land portion 36 and an FPC 50 including leads independent of each other corresponding to respective individual electrodes 35 so that a potential of each one of individual electrode can be controlled independently of another individual electrode.

Subsequently, driving methods of the actuator unit 21 will be described. In the actuator unit 21, the piezoelectric sheet 41 is to be polarized in its thickness direction. That is, the actuator unit 21 has a so-called unimorph structure in which an upper (i.e., distant from the pressure chamber 10) piezoelectric sheet 41 is a layer including active layers and the lower (i.e., near the pressure chamber 10) three piezoelectric sheets 42 to 44 are inactive layers. When the individual electrode 35 is set at a positive or negative predetermined potential, therefore, portions of the piezoelectric sheet 41 applied with an electric field, as sandwiched between the electrodes, act as active layers or pressure generating parts to contract perpendicularly to a polarization by a transversal piezoelectric effect, if, for example, the electric field and the polarization are in the same direction.

In this embodiment, portions of a piezoelectric sheet 41 sandwiched between the main electrode regions 35*a* and the common electrode 34 act as active layers that produce a strain by a piezoelectric effect when applied with an electric field. On the other hand, the three piezoelectric sheets 42 to 44 disposed under the piezoelectric sheet 41 are not applied with any electric field from outside, and therefore hardly function as active layers. Accordingly, the portions of the piezoelectric sheet 41 sandwiched between the main electrode regions 35*a* and the common electrode 34 mainly contract perpendicularly to the polarization by the transversal piezoelectric effect.

Figure 11:
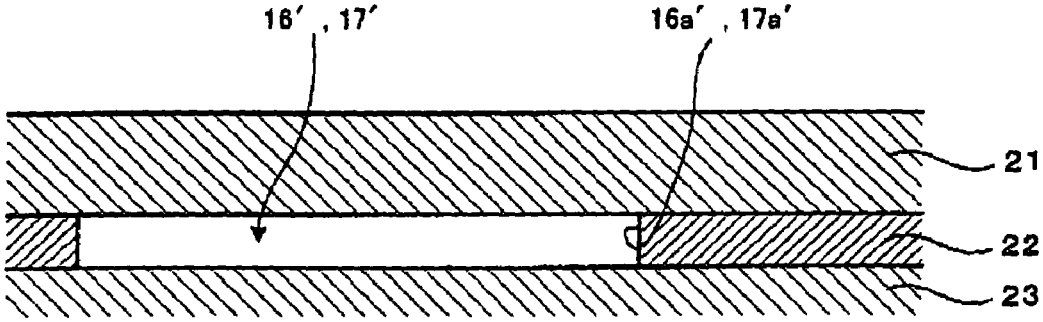
FIG. 11 is a partial sectional view corresponding to a peripheral cavity in the head main body illustrated in FIG. 10.

On the other hand, because the piezoelectric sheets 42 to 44 are not affected by the electric field, they do not displace by themselves. Thus, a difference in strain perpendicular to the polarization is produced between the upper piezoelectric sheet 41 and the lower piezoelectric sheets 42 to 44. As a result, the piezoelectric sheets 41 to 44 as a whole are ready to deform (i.e., a unimorph deformation) into a convex shape toward the inactive side. At this time, as shown in FIG. 11, a lower face of the actuator unit 21 constituted by the piezoelectric sheets 41 to 44 is fixed on an upper face of a partition or a cavity plate 22 defining a pressure chamber, so that the piezoelectric sheets 41 to 44 deform into the convex shape toward the pressure chamber side. Therefore, the volume of the pressure chamber 10 is decreased to raise a pressure of ink so that the ink is ejected from a nozzle B. Then, when the individual electrode 35 is returned to the same potential as that of the common electrode 34, the piezoelectric sheets 41 to 44 restore their original shape, and the pressure chamber 10 also restores its original volume so that the pressure chamber 10 draws ink from a sub-manifold channel 5*a*.

In another driving method, all individual electrodes 35 are set in advance at a potential different from that of the common electrode 34. When an ejection request is issued, a corresponding individual electrode 35 is set at the same potential as that of the common electrode 34. Then, at a predetermined timing, the individual electrodes 35 can also be set again at the potential different from that of the common electrode 34. In this case, at the timing when the individual electrode 35 is set at the same potential as that of the common electrode 34, the piezoelectric sheets 41 to 44 return to their original shapes. The corresponding pressure chamber 10 is thereby increased in volume from its initial state (in which potentials of both electrodes are different from each other), such that ink is drawn from a sub-manifold channel 5*a* into the pressure chamber 10. Subsequently, at the timing when the individual electrode 35 is set again at the potential different from that of the common electrode 34, the piezoelectric sheets 41 to 44 deform into a convex shape toward the pressure chamber 10. The volume of the pressure chamber 10 is thereby decreased, and the pressure of ink in the pressure chamber 10 is raised to eject the ink.

Referring again to FIG. 4, a band region R will here be discussed that has a width (about 678.0 micrometers) corresponding to 37.5 dpi in the arrangement direction A and extends in the direction perpendicular to the arrangement direction A (in the forth direction). In this band region R, any of sixteen pressure chamber rows 11*a* to 11*d* includes only one nozzle 8. That is, when such a band region R is defined at an optional position in an ink ejection region corresponding to one actuator unit 21, sixteen nozzles 8 are always distributed in the band region R. Positions of points respectively obtained by projecting these sixteen nozzles 8 onto a straight line extending in the arrangement direction A are distant from each other by a distance corresponding to 600 dpi as a resolution upon printing.

When the sixteen nozzles 8 included in one band region R are denoted by (1) to (16) in order from one whose projected image onto a straight line extending in the arrangement direction A is the leftmost, the sixteen nozzles 8 are arranged in the order of (1), (9), (5), (13), (2), (10), (6), (14), (3), (11), (7), (15), (4), (12), (8), and (16) from the lower side. In the ink-jet head 1 having this structure, by properly driving the inside of the actuator unit 21 in accordance with transfer of a print medium, a character, a figure, or the like, having a resolution of 600 dpi can be formed.

By way of example, a case will be described in which a straight line extending in the arrangement direction A is printed at a resolution of 600 dpi. First, a reference example case will be briefly described in which nozzles 8 communicate with the same-side acute portions of pressure chambers 10. In this case, in accordance with transfer of a print medium, ink ejection starts from a nozzle 8 in a lowermost pressure chamber row in FIG. 4. Ink ejection is then shifted upward with selecting a nozzle 8 belonging to an upper neighboring pressure chamber row in order. Ink dots are thereby formed in order in the arrangement direction A while neighboring each other at 600 dpi. Finally, all the ink dots form a straight line extending in the arrangement direction A at a resolution of 600 dpi.

In this embodiment, on the other hand, ink ejection starts from a nozzle 8 in a lowermost pressure chamber row 11*b* in FIG. 4, and ink ejection is then shifted upward with selecting a nozzle 8 communicating with an upper neighboring pressure chamber row in order in accordance with transfer of a print medium. In this embodiment, however, since a positional shift of nozzles 8 in the arrangement direction A per pressure chamber row from the lower side to the upper side is not always the same, ink dots formed in order in the arrangement direction A in accordance with the transfer of the print medium are not arranged at regular intervals at 600 dpi.

More specifically, as shown in FIG. 4, in accordance with the transfer of the print medium, ink is first ejected through a nozzle (1) communicating with the lowermost pressure chamber row 11*b* in FIG. 4 to form a dot row on the print medium at intervals corresponding to 37.5 dpi. Then, as the print medium is transferred and a straight line formation position has reached a position of a nozzle (9) communicating with a second lowermost pressure chamber row 11*a*, ink is ejected through the nozzle (9). A second ink dot is thereby formed at a position shifted from a first formed dot position in the arrangement direction A by a distance of eight times the interval corresponding to 600 dpi.

Next, as the print medium is further transferred and the straight line formation position has reached a position of a nozzle (5) communicating with a third lowermost pressure chamber row 11*d*, ink is ejected through the nozzle (5). A third ink dot is thereby formed at a position shifted from the first formed dot position in the arrangement direction A by a distance of four times the interval corresponding to 600 dpi. As the print medium is further transferred and the straight line formation position has reached a position of a nozzle (13) communicating with a fourth lowermost pressure chamber row 11*c*, ink is ejected through the nozzle (13). A fourth ink dot is thereby formed at a position shifted from the first formed dot position in the arrangement direction A by a distance of twelve times the interval corresponding to 600 dpi. As the print medium is further transferred and the straight line formation position has reached a position of a nozzle (2) communicating with a fifth lowermost pressure chamber row 11*b*, ink is ejected through the nozzle (2). A fifth ink dot is thereby formed at a position shifted from the first formed dot position in the arrangement direction A by a distance corresponding to 600 dpi.

Afterwards, in the same manner, ink dots are formed with selecting nozzles 8 communicating with pressure chambers 10 in order from the lower side to the upper side in FIG. 4. In this case, when the number of a nozzle 8 in FIG. 4 is N, an ink dot is formed at a position shifted from the first formed dot position in the arrangement direction A by a distance corresponding to (magnification n=N−1)×(interval corresponding to 600 dpi). When the sixteen nozzles 8 have been finally selected, a gap between the ink dots formed by the nozzles (1) in the lowermost pressure chamber rows 11*b* in FIG. 4 at an interval corresponding to 37.5 dpi is filled up with fifteen dots formed at intervals corresponding to 600 dpi. Thus, as the whole, a straight line extending in the arrangement direction A can be drawn at a resolution of 600 dpi.

At a vicinity of both ends of each ink ejection region in the arrangement direction A (oblique sides of the actuator unit 21), a printing at a resolution of 600 dpi can be performed by making a compensation relation to a vicinity of both ends, in the arrangement direction A, of another ink ejection region corresponding to an opposite actuator unit 21 in the width of a head main body 70.

A second embodiment of the invention will hereinafter be described. An ink-jet head according to this embodiment has the same structure as that of the first embodiment, except for a shape of a peripheral cavity. Thus, in the following, a description will be made focusing on a difference between the first and the second embodiment. Here in this embodiment, the same members as those of the first embodiment will be indicated by the common reference numerals and will not be described.

Figure 10:
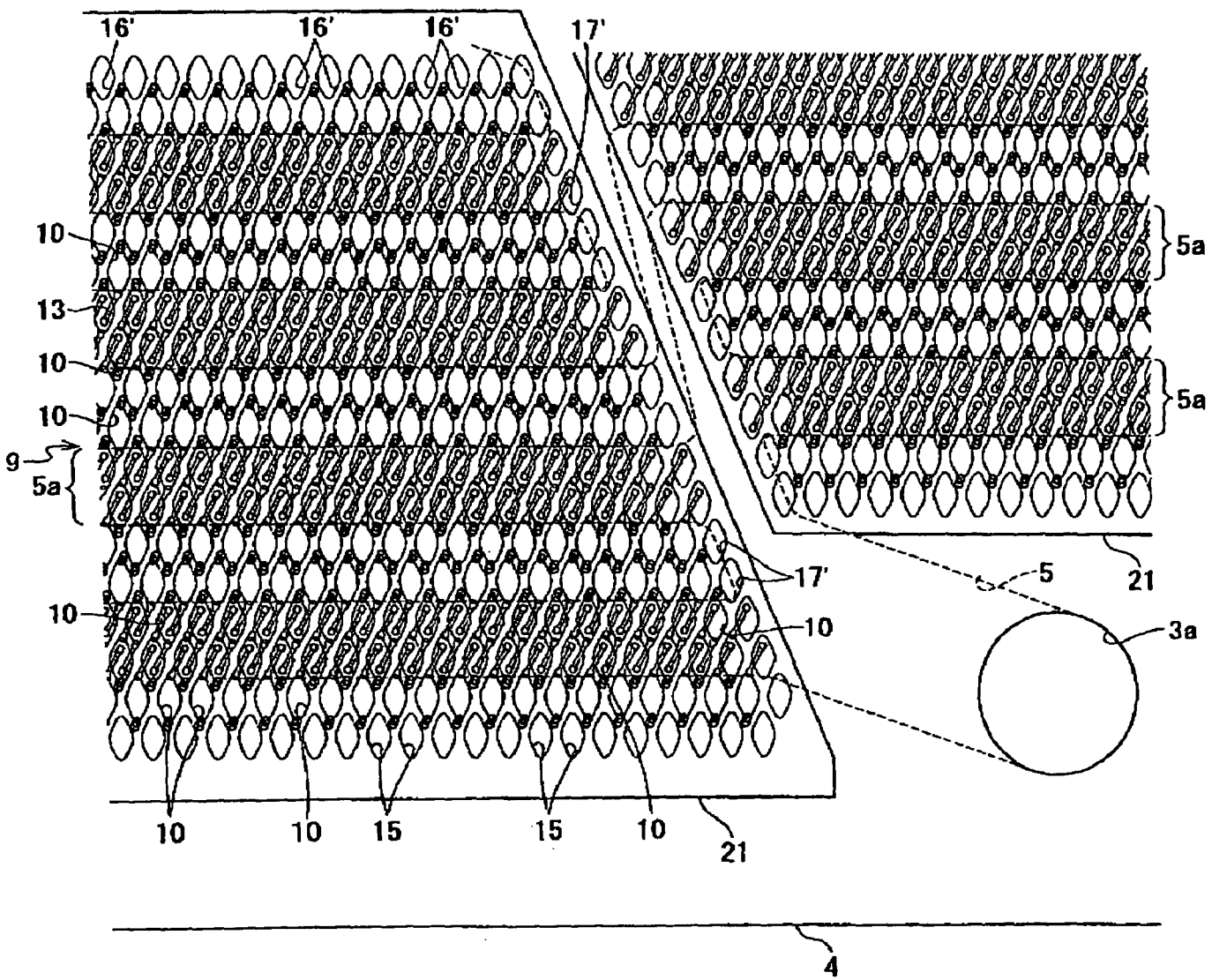
FIG. 10 is an enlarged plan view of a head main body in an ink-jet head according to a second embodiment of the invention.

FIG. 10 is an enlarged plan view of a head main body according to this embodiment. In this embodiment, as shown in FIG. 10, in a head main body 70, a large number of peripheral cavities 15 having the same shape and the same size as those of a pressure chamber 10 are arranged in a straight line along a long side of a group of pressure chambers 9 over a whole area of the long side. Also, a large number of peripheral cavities 16' having the same shape and the same size as those of a pressure chamber 10 are arranged in a straight line along a short side of the group of pressure chambers 9 over a whole area of the short side. Further, a large number of peripheral cavities 17' having the same shape and the same size as those of a pressure chamber 10 are arranged in a straight line along both oblique sides of the group of pressure chambers 9 over a whole area of the both oblique sides. The peripheral cavities 16', 17' are, as shown in FIG. 11 showing a section of a vicinity thereof, defined by laminating an actuator unit 21, a cavity plate 22, and a base plate 23 such that holes (peripheral holes 16'*a*, 17'*a*) formed in the cavity plate 22 and having the same shape and the same size as those of the pressure chamber 10 may be closed by the actuator unit 21 and the base plate 23. The peripheral cavities 15, 16', and 17' are not connected with ink passages, and therefore, do not perform an ink ejection.

The peripheral cavities 16', 17' are formed at the same positions as those of the peripheral cavities 16, 17 in the first embodiment. That is, the peripheral cavities 16', 17' are formed with the same pitches as those of the pressure chambers 10 with respect to a longitudinal direction of a passage unit 4 and the arrangement direction B, respectively. Moreover, a distance between each peripheral cavity 16', 17' and a pressure chamber 10 adjacent thereto is the same as a distance between the neighboring pressure chambers 10 in the group of pressure chambers 9. Further, a part of a contour (two sides or one side leading to one acute portion of a rhombic shape) of each peripheral cavity 16', 17' and a part of a contour (two sides or one side leading to one acute portion of a rhombic shape) of a pressure chamber 10 facing to each other are parallel. One acute portion of a peripheral cavity 16' is located between two pressure chambers 10 adjacent to this peripheral cavity 16'.

As described above, in this embodiment, each group of pressure chambers 9 formed in the head main body 70 is surrounded by a large number of peripheral cavities 15, 16', and 17' having the same shape and the same size as those of the pressure chamber 10 and formed over a whole periphery of the group of pressure chambers 9 at the same interval as that of neighboring pressure chambers. Accordingly, a passage for a pressure chamber 10 disposed at an outermost periphery of a group of pressure chambers 9 can be prevented with higher probability from being clogged by a flowed-in adhesive during bonding an actuator unit 21 and a cavity plate 22, and at the same time the pressure chamber 10 disposed at the outermost periphery of the group of pressure chambers 9 and a pressure chamber 10 disposed at a portion other than the outermost periphery of the group of pressure chambers 9 are prevented from being different from each other in their shapes due to a flowed-in adhesive, so that both of these pressure chambers 10 have almost the same shape. Further, the pressure chamber 10 disposed at the outermost periphery of the group of pressure chambers 9 and the pressure chamber 10 disposed at the portion other than the outermost periphery of the group of pressure chambers 9 have the same positional relationship with cavities, which means any pressure chambers 10 or any peripheral cavities, surrounding each of these pressure chambers 10. Further, cavities surrounding any pressure chamber 10 have the same shape. Therefore, there is not caused a substantial difference in a bending amount of sidewalls of pressure chambers between both of these pressure chambers during ink ejection. Accordingly, in the ink-jet head according to this embodiment, the pressure chamber 10 disposed at the outermost periphery of the group of pressure chambers 9 and the pressure chamber 10 disposed at the portion other than the outermost periphery of the group of pressure chambers 9 demonstrate almost the same ink ejecting characteristics. Like this, the peripheral cavities 15, 16, and 11 contribute to an ink ejection in terms of providing uniform ink ejecting characteristics of the pressure chambers 10.

As mentioned above, the first and the second embodiments provide the same structure except for a shape of the peripheral cavity. Therefore, either one of these embodiments may be suitably selected and adopted in accordance with specific design conditions such as a position for drawing out a wiring of the common electrode. In the aforementioned first and second embodiments, although the contours of facing portions of the peripheral cavity and the pressure chamber are parallel to each other, the contours may not be parallel. The peripheral cavity and the pressure chamber may not have the same shape in a plan view. A distance between the peripheral cavity and the pressure chamber may not be the same as a distance between the neighboring pressure chambers. The actuator unit may not close the opening of the peripheral cavity. Further, one acute portion of the peripheral cavity may not be located between two pressure chambers adjacent to this peripheral cavity.

Moreover, although, in the aforementioned first and second embodiments, the cavity recesses each constituting a cavity of each pressure chamber are arranged on the surface of the passage unit 4, another plate for closing the cavity recesses may be laminated within the passage unit 4, and then the actuator unit may be laminated on the plate. A shape of the pressure chamber 10 may be elliptical, parallelogramic, or rectangle. Further, the pressure chamber 10 may be in a shape of parallelogram or rhomboid with each corner thereof being rounded. A shape of the group of pressure chambers is not limited to trapezoid, and may be arbitrarily changed.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage unit including a plurality of cavity recesses arranged in a matrix, each communicating with both a nozzle for ejecting ink and a common ink chamber and each constituting a cavity of a pressure chamber, and a plurality of peripheral recesses arranged along a whole periphery of the plurality of cavity recesses and each communicating with neither the nozzle nor the common ink chamber; and an actuator unit that closes openings of the cavity recesses to define a plurality of pressure chambers with the passage unit, and change the volume of each pressure chamber, wherein the plurality of peripheral recesses are arranged along a whole periphery of the plurality of cavity recesses to surround the plurality of cavity recesses.

2. The ink-jet head according to claim 1, wherein the plurality of peripheral recesses are arranged at a same interval as that between the cavity recesses.

3. The ink-jet head according to claim 1, wherein a contour of a region of an opening of the peripheral recess facing to the cavity recess is parallel to a contour of a region of the opening of the cavity recess facing to the peripheral recess.

4. The ink-jet head according to claim 1, wherein the opening of the peripheral recess has a same shape and a same size as those of the opening of the cavity recess.

5. The ink-jet head according to claim 1, wherein a distance between the peripheral recess and the cavity recess is the same as a distance between the neighboring cavity recesses.

6. The ink-jet head according to claim 1, wherein the actuator unit is fixed to passage unit such that the opening of each cavity recess and the opening of each peripheral recess is closed.

7. The ink-jet head according to claim 1, wherein the opening of the cavity recess and the opening of the peripheral recess have a shape of parallelogram with two acute portions, and one acute portion of the opening of the peripheral recess is located between the openings of two cavity recesses adjacent to the relevant peripheral recess.

8. An ink-jet head comprising:

a first plate including a plurality of cavity holes arranged in a matrix, each constituting a cavity of a pressure chamber, and a plurality of peripheral holes arranged along a whole periphery of the plurality of cavity holes;

a second plate put on one face of the first plate such that an opening on one side of each cavity hole is closed; and a third plate formed with first and second connection holes corresponding to each of the plurality of cavity holes, the third plate being put on the other face of the first plate such that the first and second connection holes are connected with the corresponding cavity hole to define the plurality of pressure chambers with the first plate and the second plate, wherein the plurality of peripheral holes are arranged along a whole periphery of the plurality of cavity holes to surround the plurality of cavity holes.

9. The ink-jet head according to claim 8, wherein the plurality of peripheral holes are arranged at a same interval as that between the cavity holes.

10. The ink-jet head according to claim 8, wherein a contour of a region of an opening on one side of the peripheral hole facing to the cavity hole is parallel to a contour of a region of the opening on one side of the cavity hole facing to the peripheral hole.

11. The ink-jet head according to claim 8, wherein the opening on one side of the peripheral hole has a same shape and a same size as those of the opening on one side of the cavity hole.

12. The ink-jet head according to claim 8, wherein a distance between the peripheral hole and the cavity hole is the same as a distance between the neighboring cavity holes.

13. The ink-jet head according to claim 8, wherein the second plate is put on one face of the first plate such that the opening on one side of each cavity hole and the opening on one side of each peripheral hole are closed.

14. The ink-jet head according to claim 8, wherein the opening on one side of each peripheral hole is closed with the second plate, and the opening on the other side of each peripheral hole is closed with the third plate.

15. The ink-jet head according to claim 8, wherein openings on both sides of the cavity hole and openings on both sides of the peripheral hole have a shape of parallelogram with two acute portions, and one acute portion of each opening of the peripheral hole is located between the openings of two cavity holes adjacent to the relevant peripheral hole.

* * * * *